United States Patent [19]

Lanese

[11] 4,290,003

[45] Sep. 15, 1981

[54] HIGH VOLTAGE CONTROL OF AN ELECTROSTATIC PRECIPITATOR SYSTEM

[75] Inventor: Philip M. Lanese, Belle Mead, N.J.

[73] Assignee: Belco Pollution Control Corporation, Parsippany, N.J.

[21] Appl. No.: 33,604

[22] Filed: Apr. 26, 1979

[51] Int. Cl.[3] ..... B03C 3/68

[52] U.S. Cl. ..... 323/241; 55/105; 323/246; 323/903

[58] Field of Search ..... 55/105, 139; 307/297, 307/236; 323/9, 20, 22 SC, 24, 34; 361/35

[56] References Cited

U.S. PATENT DOCUMENTS

| | | | |
|---|---|---|---|
| 3,444,455 | 5/1969 | Johnson et al. | 323/24 X |
| 3,507,096 | 4/1970 | Hall et al. | 55/105 |
| 3,535,614 | 10/1970 | Wilson | 323/24 X |
| 3,577,708 | 5/1971 | Drenning et al. | 55/105 |
| 3,772,853 | 11/1973 | Burge et al. | 55/105 |
| 3,959,715 | 5/1976 | Canning | 55/105 |
| 4,138,232 | 2/1979 | Winkler et al. | 323/24 X |
| 4,147,972 | 4/1979 | Hochstetter | 323/24 |
| 4,152,124 | 5/1979 | Davis | 323/24 X |
| 4,160,202 | 7/1979 | James et al. | 55/105 X |

*Primary Examiner*—A. D. Pellinen
*Attorney, Agent, or Firm*—Marvin A. Naigur; John E. Wilson; John J. Herguth, Jr.

[57] ABSTRACT

There is provided a precipitator system including a voltage controller which produces from an alternating power source a variable output. This variable output drives a high voltage converter which applies a high voltage to a precipitator. This variable output is controlled by a control signal from a command subsystem. Preferably, the command subsystem is operative to repress the drive to the high voltage converter in response to its loading exceeding a predetermined limit during a corresponding limit interval. After this limit interval, the command subsystem is operative to rapidly restore productive drive to the high voltage converter, preferably by the next half cycle of the power source that has a polarity opposite to that existing at the beginning of the limit interval. In this fashion stablized operation is quickly achieved. Also included, preferably, is a conductive element that is coupled to the high voltage converter. This conductive element conducts in response to variations in the extent to which the high voltage converter is being driven. The command system may store successive values of the voltage across the conductive element, using such values to adjust the control signal according to a predetermined relationship. Such an arrangement can be used to adjust the control signal when a spark is imminent, thereby avoiding it.

36 Claims, 16 Drawing Figures

FIG. 2
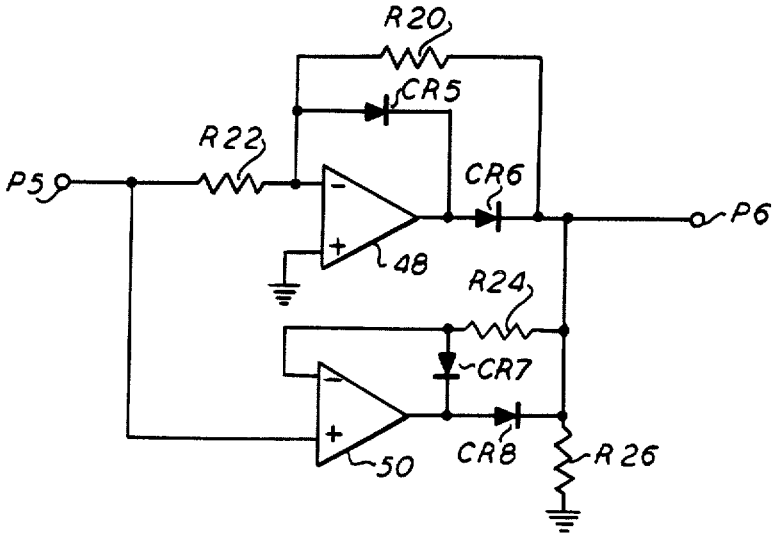
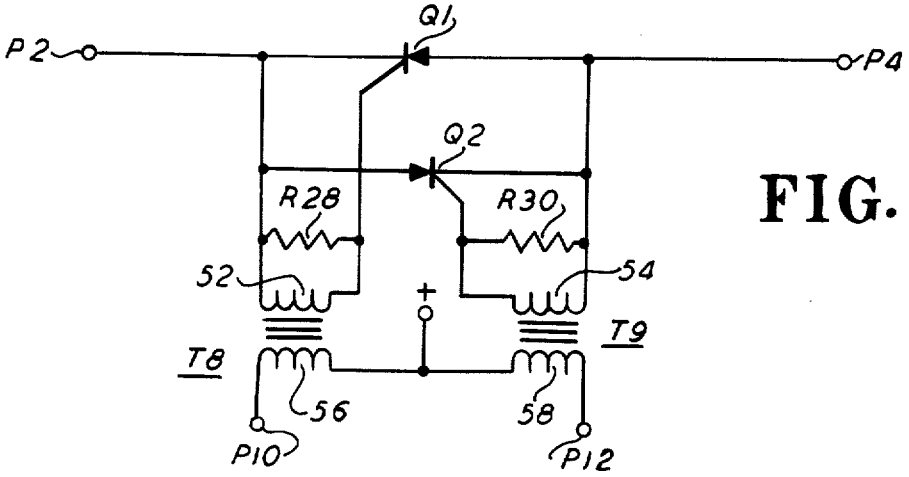
FIG. 3

HIGH VOLTAGE CONTROL OF AN ELECTROSTATIC PRECIPITATOR SYSTEM

BACKGROUND OF THE INVENTION

In many processes, the resulting exhaust gas is cleansed by an electrostatic precipitator which employs a high voltage to ionize and deflect particulate matter. Known precipitator systems control the magnitude of this high voltage by adjusting it to produce sparking at a predetermined rate. Since sparks are easily detected, such spark-rate control is readily implemented but only with a great loss in performance and reliability. By allowing repeated sparking, these systems severely stress the power supply and its transformer-rectifier. In addition, the collecting plates and emitting wires of the precipitator are continually eroded.

Known precipitator systems have responded to excessive sparking or arcing that randomly occurs during typical operations, by quickly disabling the high voltage supply and then restoring it gradually. This gradual restoration known as a "slow" or "soft" start, avoids excessive initial currents and voltages. Such excessive initial loads are the consequence of a heavy spark or arc driving magnetic devices in the high voltage supply into saturation.

In the event that the core of a high voltage transformer saturates, reapplication of power without regard to voltage polarity can result in further saturation and a consequently low impedance path that shunts excessive current from the power mains. Alternatively, a conventional series reactor in the primary circuit of the high voltage transformer may saturate. In a similar fashion, this saturated reactor can provide insufficient limiting impedance so that the transformer is overdriven, producing at its secondary, excessive high voltage. The foregoing produces a self-defeating sequence whereby a spark produces a high voltage transient that causes another spark. The aforementioned "slow" start systems cope with this phenomena by gradually restoring drive to the magnetic circuits thereby allowing rebalance of their magnetic cores and operation on a central and symmetrically hysterisis loop.

An inherent disadvantage with delaying restoration of full power to a high voltage supply is that the charge within the precipitator decays. It is to be appreciated that while a spark constitutes a significant loss of energy, initially the effect is localized. Thus, adjacent precipitator sections can initially maintain their charges because the effective series resistance and inductance between precipitator sections is not negligible. In fact, these impedances become predominant when a spark produces a localized low impedance current path. Accordingly, sparks, which are commonly of a short duration (1 to 4 milliseconds), are followed by an interval in which charge can be advantageously redistributed. Thus a localized discharge can be immediately followed by a replenishment of charge and at a lower magnitude. However, since known system repress power beyond this redistribution interval, they allow the remaining overall charge to dissipate.

If the precipitator charge is allowed to decay in this fashion, the system is so disabled that collected dust can become reentrained. This reentrained dust increases the probability of another spark, again initiating a self-defeating sequence. Once the precipitator has been so discharged, the current handling limitations of the equipment, the capacitance of the precipitator and the inductance of the series reactor render it impossible to instantaneously restore the charge on the precipitator. Accordingly, these known systems devote a significant amount of time recharging unnecessarily discharged precipitators. This non-productive cycling defeats effective voltage control. The present invention by quickly restoring power, more nearly achieves the theoretical maximum power described hereinafter.

The deleterious effect of a ramp-type process can be illustrated by assuming that a spark is followed by an interval of duration DTa during which power is removed. Thereafter it is assumed that the charging current is linearly increased for an interval of duration DTb after which time a constant value of maximum current Im is reached. (The following analysis can be readily extended to the other forcing functions such as a piecewise linear ramp having an initially high and subsequently low slopes). Since the energy delivered is the effective resistance R multiplied by the time integral of the square of the current, total energy will be:

$$R \int_0^{DTb} \left[ \frac{Im}{DTb} t \right]^2 dt + R \int_{DTb}^{t} Im^2 dt$$

setting t=0 as the instant at which the charging current commences. If the foregoing is solved for t=Tf−DTa where Tf is the period at which the process repeats, the energy per cycle is:

$$Im^2 R \left[ Tf - DTa - \frac{2DTb}{3} \right]$$

Clearly then, the maximum value of energy occurs when DTa=DTb=0. Under those circumstances the maximum theoretical power is delivered which by inspection is: $Im^2R$. If the ramping interval corresponding to quanitity DTb were eliminated, the charging current would become a square wave and the power delivered then would be the maximum theoretical power multiplied by the duty cycle (DTa/Tf). This duty cycle can approach its maximum value of one, if the time between sparks is made arbitrarily large or the interval after sparking when power is repressed is made arbitrarily small. By alternately discharging and recharging the precipitator, these known systems effectively masked subtle electrical variations which are useful in controlling the high voltage. Because the transients caused by sparking and the inrush currents due to recharging are so large, these known control systems were designed to respond to an easily detectable phenomena: the spark itself. Moreover, while one might very gradually increase the drive to a high voltage supply in an attempt to detect subtle electrical variations, the net result is that the high voltage will languish at an inefficiently low voltage.

The present invention avoids these problems by operating in a stabilized fashion. During the occurrence of a spark, power is repressed to the extent possible, in one embodiment of the invention. Thereafter power is quickly restored to nearly the prespark value. In a preferred embodiment, power restoration is timed so that if sparking has caused saturation of a magnetic device of the high voltage supply, that device is immediately driven in a direction away from saturation.

In addition, in a preferred embodiment of the invention, the present value of the drive being applied to a high voltage converted is compared to a previous value. In this manner, electrical disturbances which are the precursors of sparking are detected. Accordingly, the system can adjust itself prior to the occurrence of a spark and thus avoid it. Therefore systems according to the present invention are designed to operate without sparking. Preferably, the adjustments made to avoid a spark are relatively small in magnitude so as not to disturb the essentially steady-state conditions achieved. Such quiescence facilitates continued detection of an imminent spark. With the foregoing technique the high voltage can be continuously adjusted upward to an efficient value without encouraging unnecessary sparking. The equipment produces increases of up to 200 percent in the real power available in the precipitator.

In a typical operation of the preferred embodiment, the conduction angle of anti-parallel silicon controlled rectifiers (SCRs) are increased at some rate that will provide a fast but controlled rise in the output of a high voltage transformer. The rate of increase of SCR conduction angle may be modified by feeding back to the control a signal derived from the voltage drop across a linear current limiting reactor included in the primary circuit, such signal being indicative of the rate of power acceptance of the precipitator itself. The control may also, for each individual half cycle of operation, respond to measured quantities such as the voltages and currents appearing in the transformer primary or secondary circuits (i.e., the precipitator). Such system can also include a means for storing those measured values for comparisons at the next or some later half cycle. In this way, when a spark occurs all of the latest values of all measurable electrical parameters are available for evaluation.

With the disclosed apparatus, a fast comparison can be made, for instance, between the secondary voltage and/or current at which the spark occurred and the SCR conduction angle required to produce it. Additional information could include: whether or not the SCR conduction angle was advanced or retarded at some time just prior to the spark, the SCR conduction angle itself, secondary voltage and/or current, linear reactor voltages or any other discernable characteristics existing prior to the spark. Thus the new "local time average" may be formed and the control would now be ready to resume operation. Since reenergization follows the method disclosed, the control may produce a new SCR conduction angle such that operation is resumed so as to immediately (within one or two half cycles) produce secondary voltages and/or currents at or just below those at which the first spark occurred. If another spark is generated, another local average can be obtained and the process repeated. In this way the secondary voltage and/or current is reduced until no spark occurs upon or shortly after reenergization. By decreasing the SCR conduction angle by small amounts (less than one electrical degree) it is possible to obtain long term (several dozen half cycles) operation just below the levels of voltage and/or current that previously produced a spark but more importantly, the system is allowed to stabilize quickly so that spark onset conditions may be readily detected.

If no evidence of spark onset is detected from monitoring half cycles, the SCR conduction angle may be increased but again only by a small amount and in a single step, so as to disturb the steady state conditions as little as possible. The control continues forming local averages and at some conduction angle, the spark onset disturbances will become detectable. At this point it is designers choice as to what type of action the control should take. Operation over several half cycles however, will indicate that continued operation at present levels of voltage and/or current will lead to a spark so the obvious action to take would be to decrease the SCR conduction angle by an amount which could depend on the amplitude (or distribution) of the onset disturbance. Data is then recollected to see in what way, if any, the disturbance was affected, and another decision made. Operation would be continued and the control would normally increase the SCR conduction angle whenever possible to provide maximum field potential and maximum ionizing current in a manner that is modified by the data being continuously collected, so as to rapidly lower the power by a very small amount when conditions indicate onset of sparking.

In a preferred embodiment the foregoing comparison measurement is performed periodically to eliminate periodic effects caused by an alternating energizing current.

Also, the instant at which a measurement is made can be set to correspond to the time at which current variations are most representative of the imminence of sparking. For example, sparking may be likely in a predetermined interval after a voltage controller is adjusted or, for alternating current, at predetermined phase angles.

In addition, embodiments incorporating principles of the present invention may repetitively increment a control signal which is controlling the extent to which a high voltage converter is driven. This process can be reversed if the high voltage begins to fall at the onset of back-corona.

SUMMARY OF THE INVENTION

In accordance with an illustrative embodiment demonstrating features and advantages of the present invention, there is provided in an electrostatic precipitator system, a high voltage means. This precipitator system includes a voltage controller for producing from a primary power source a variable output which varies in response to a control signal. The high voltage means includes a high voltage converter means driven by the voltage controller for producing therefrom a variable high voltage. There is also included a command means for producing and varying the control signal. The command means is operative to repress the drive to the high voltage converter means. Repression of the high voltage converter means occurs in response to its loading exceeding a predetermined limit during a corresponding limit interval. The command means is operative after the limit interval to restore productive drive to the converter means by the next half cycle of the power source that has a polarity opposite to that existing at the beginning of the limit interval.

Also in accordance with the present invention there is provided a method for varying the high output voltage produced by a high voltage converter means associated with an electrostatic precipitator. The converter means is driven by a voltage controller. This controller produces an output that varies in response to a control signal. The converter means has coupled to it a conductive element for conducting by an amount corresponding to the extent to which the converter means is being driven to produce a high voltage. The method comprises the step of initially measuring the voltage across said conductive element. Another step is advancing the control signal in a direction to increase the extent to which the high voltage converter means is driven. The method also includes the step of remeasuring the voltage across the conductive element at a predetermined interval after the initial measurement thereof. Another step of the method is varying the control signal in a direction to decrease the output of the controller in response to a predetermined variation in the magnitude of the voltage across the conductive element over the predetermined interval.

Also in accordance with an illustrative embodiment demonstrating features and advantages of the present invention, there is provided in an electrostatic precipitator system, a high voltage means. This precipitator system includes a voltage controller for producing from a primary power source a variable output which varies in response to a control signal. The high voltage means includes a high voltage converter means driven by the voltage controller for producing therefrom a variable high voltage. Also included is a conductive element coupled to the high voltage converter means. This element is operative to conduct in response to variations in the extent to which the high voltage converter means is being driven to produce a high voltage. The high voltage means also includes a command means responsive to the voltage across the conductive element for producing the control signal. This command means includes a storage means. The storage means is operative to produce a base signal responsive to at least one prior value of the voltage across the conductive element. The command means produces the control signal at a magnitude bearing a predetermined relationship to the base signal and the present value of the voltage across the conductive element. Thus, the precipitator system responds to parameters indicating the imminence of high voltage sparking.

BRIEF DESCRIPTIONS OF THE DRAWINGS

The above brief description as well as further objects features and advantages of the present invention will be more fully appreciated by reference to the following detailed description of a presently preferred but nonetheless illustrative embodiment in accordance with the present invention, when taken in connection with the accompanying drawings wherein:

FIG. 2 is a schematic diagram of an absoluting buffer employed in the precipitator system of FIG. 1;

FIG. 3 is a partial schematic diagram of a voltage controller employed in the precipitator system of FIG. 1;

DETAILED DESCRIPTION OF THE PREFERRED EMBODIMENT

Figure 1:
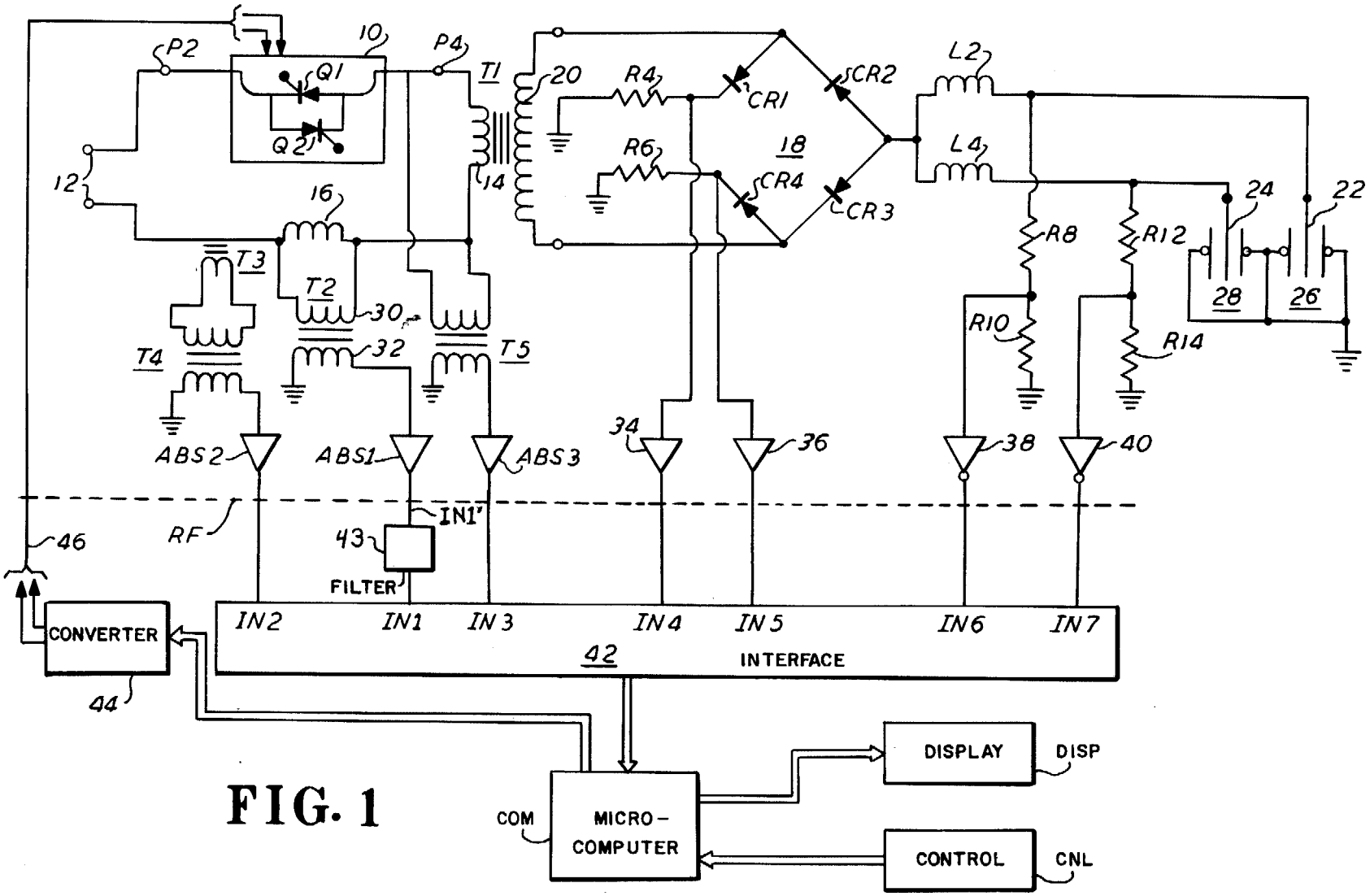
FIG. 1 is a block diagram of a precipitator system including a high voltage means arranged and constructed in accordance with principles of the present invention.

In FIG. 1 a voltage controller is shown as block 10 connected between input line P2 and output line P4. Block 10 has a pair of oppositely poled thyristors (SCR's) Q1 and Q2 connected in parallel between lines P2 and P4 so that they can support an alternating current. By triggering thyristors Q1 and Q2 to conduct through a desired phase angle, the extent of conduction therethrough can be controlled in a well-known manner. While a thyristor controller is shown herein it is apparent that other controllers employing elements such as a saturable reactor may be employed instead.

A high voltage converter means is shown herein as a transformer-rectifier set T1, 18. A conductive element is shown as limiting inductor 16 which is in series circuit across the primary power input terminals 12 together with controller 10 and primary 14 of high voltage transformer T1. The high voltage converter is provided by transformer T1 and a full wave bridge 18, comprising diodes CR1, CR2, CR3 and CR4. The anode of diode CR1 and the cathode of diode CR2 are connected to one terminal of secondary 20, its other terminal being connected to the cathode of diode CR3 and the anode of diode CR4. The cathodes of diodes CR1 and CR4 are shunted to ground by resistors R4 and R6, respectively. The anodes of diodes CR2 and CR3 are connected to the junction of surge-limiting inductors L2 and L4. Having a high turns ratio, transformer T1 produces a negative, directcurrent voltage at the junction of inductors L2 and L4 which is of a high magnitude.

While conductive element 16 is shown as current limiting reactor, it is apparent that a resistive element may be employed in other embodiments. Being inductive, element 16 has the advantage of being responsive to transient phenomena indicative of imminent sparking. However, good sensitivity to transients may also be obtained by employing a serially connected resistor whose voltage drop is differentiated. While element 16 is shown serially connected to primary T1, it may be connected in other suitable locations which will cause it to conduct in response to the extent to which transformer T1 and diodes CR1, CR2, CR3 and CR4 are driven. For example, a voltage divider may be connected between ground and the junction of diodes CR2 and CR3 to sense the extent to which the high voltage converter is driven.

The non-common terminals of inductors L2 and L4 are separately connected to high tension electrodes 22 and 24, respectively, of precipitators 26 and 28. Precipitators 26 and 28 are constructed in a well-known manner and are disposed in the path of the exhaust from a machine or a process. Sufficiently high electric fields within precipitators 26 and 28 will ionize and deflect particles in the exhaust thereby cleansing it.

Element 16 is connected in parallel with primary 30 of transformer T2 and its secondary 32 is connected between ground and the input of absoluting buffer ABS1. Absoluting buffer ABS1 (details given hereinafter) produces a unipolar signal having a magnitude proportional to the absolute value of its input.

A signal proportional to the primary current of transformer T1 is provided by current transformer T3 which is inductively coupled to the line between input 12 and element 16. Current transformer T3 is coupled to absoluting buffer ABS2 by means of isolation transformer T4. Absoluting buffer ABS2 is identical in construction to buffer ABS1. The primaries of transformers T1 and T5 are connected in parallel. The secondary of transformer T5 drives the input of absoluting buffer ABS3 whose construction is identical to that of buffer ABS1. It is apparent that buffers ABS2 and ABS3 are driven by voltages proportional to the primary current and voltage, respectively, of high voltage transformer T1. The secondary current of transformer T1 flows through either resistor R4 or R6, this current alternating therebetween for successive half-cycles. This secondary current signal is transmitted by non-inverting buffer amplifiers 34 and 36 which are separately connected to the ungrounded terminals of resistors R4 and R6, respectively.

A high voltage sensing means is shown herein as a pair of dividers, although a Hall-effect device or other apparatus may be used instead. Connected between high tension electrode 22 and ground is one such voltage divider, comprising serially connected resistors R8 and R10. Similarly, a divider, comprising serially connected resistors R12 and R14, is connected between high tension electrode 24 and ground. The junction of resistors R8 and R10 is connected to the input of inverting buffer amplifier 38 to drive it with a voltage proportional to the operating potential of precipitator 26. Similarly inverting buffer amplifier 40, being connected to the junction of resistors R12 and R14, is driven with a voltage proportional to the operating potential of precipitator 28.

For many applications, it will be convenient to locate the just described apparatus of FIG. 1 near precipitators 26 and 28. Frequently such equipment will be conveniently located adjacent to one or more smoke stacks. Since the balance of equipment can be located at a place conveniently accessible to an operator, such partitioning is indicated by dotted partition line RF.

The outputs of buffers ABS2, ABS3, 34, 36, 38 and 40 interface with inputs IN2, IN3, IN4, IN5, IN6 and IN7, respective, of subsystem 42. The output of buffer ABS1 is coupled to signal conditioning circuit 43 whose output is connected to input IN1 of subsystem 42. Circuit 43 is preferably a low pass filter, however, in some embodiments an integrator may be employed instead. While supplying seven different inputs to subsystem 42 in this manner provides reasonably detailed information on precipitator performance, it is expected that in other embodiments a different number of inputs may be employed. Subsystem 42 is part of a command means which includes a triggered monitor means (described hereinafter) driven by input IN1. The command means herein also includes microcomputer COM, its circuit details being described hereinafter. The coupling between subsystem 42 and microcomputer COM is shown as a broad arrow to suggest the existence of more than one data line and the directional flow of information. Microcomputer COM is operative to repetitively strobe inputs IN1–IN7 so that these inputs are effectively multiplexed into microcomputer COM. Microcomputer COM is also operative to transmit a control signal to subsystem 44. Subsystem 44 (further described hereinafter) is arranged to convert the control signal produced by microcomputer 42 into a pair of timing signals which are transmitted along lines 46 to controller 10 to control its conduction angle. Obviously subsystem 44 provides a suitable interface between controller 10 and command means 42. Accordingly, the structure of subsystem 44 would be significantly different if instead of thyristors, controller 10 employed a saturable reactor or other device. An operator may provide input to microcomputer COM by operating switches in control accessory CNL (described hereinafter). Microcomputer COM can display information to an operator by means of display accessory DISP(described hereinafter).

Microcomputer COM, which provides overall system control and timing may take any one of several forms. It is preferable that microcomputer COM be constructed with a commercially available microprocessor as described hereinafter. However, many alternate structures will be readily apparent to persons skilled in the art. In fact in some embodiments, analog circuitry may be employed. For example, selectable storage capacitors may be charged to potentials representing the signals on inputs IN1–IN7 at various instants of time. These stored charges may be selectively coupled to a combining network to produce a control signal.

Microcomputer COM establishes the rate and sequence in which each of the inputs IN1–IN7 transmits its respective signal to command means COM. In this embodiment this rate will be normally twice the power line frequency but subject to substantial increase under predetermined conditions. It is apparent that other rates may be employed to suit the characteristics of a specific voltage controller and precipitator.

In order to facilitate an understanding of the apparatus of FIG. 1 its operation will be briefly described under the conditions where sparking is imminent, where it has occurred and where back-corona is present.

Assume the apparatus of FIG. 1 has been recently energized and is producing a relatively low voltage on electrodes 22 and 24. Microcomputer COM addresses and receives data from inputs IN6 and IN7 for every half cycle of the power line input 12. This data, including the voltage on electrodes 22 and 24, is received after approximately 75% of a half cycle has elapsed. Such timing allows microcomputer COM to fairly assess the conditions presently existing during each half cycle and to adjust the control signal of line 46 in advance of the succeeding half cycle. For awhile, the control signal is periodically advanced every half cycle to increase the voltage of electrodes 22 and 24. The incrementation of the control signal of line 46 may in some embodiments be scaled down as the voltages of electrodes 22 and 24 approach their rated values. It is assumed in this example that sufficient voltage will cause a condition such that sparking is imminent. Assume now that during the next half cycle the corona in precipitators 26 and 28 distends and forms projections or "fingers." Such distension is the precursor of sparking and it produces a distinctive increase in precipitator current. This increase in precipitator current produces an increased voltage drop across element 16. Since the current perturbation caused by this corona distension contains substantial high frequency components, inductor 16 is especially sensitive thereto. In addition, since corona distension is likely to occur in the latter part of a half cycle of power input 12, the fact that microcomputer COM takes its measurement during that time makes it particularly sensitive to this phenomena.

Upon receiving a measurement from input IN1 after the elapse of about 75% of the then-existing half cycle, microcomputer COM compares this latest measurement against a preset threshold (for example, 2 volts). Referring to the flow diagram of FIG. 9 this sequence is shown as several branches. At branch 200 the system waits for a phasing signal at terminal 72 (further described hereinafter) indicating elapse of 75% of the half-cycle. At branch 202 the signal from input IN1 is stored and at branch 204 the threshold comparison is performed. If the threshold is exceeded the control signal is decremented as shown at branch 206 by a factor of approximately 1%. This decrement is chosen to suit the characteristics and response time of the precipitator being controlled.

After this operation (or assuming branch 206 was skipped because the threshold of branch 204 was not exceeded) the recently measured value of input IN1 has subtracted from it the previous value of IN1, as shown at branch 208. This difference is compared to a preset limit (for example 10%) as shown at branch 210 and if the limit is exceeded, the control signal is decremented, otherwise it is incremented. This decrementation and incrementation is shown at branches 212 and 214, respectively. The extent of decrementation is chosen to suit the characteristics and response time of the precipitator. The extent of incrementation at branch 214 is less than the decrement occurring at branch 206. This relation will ensure that if decrementation occurs, its effect will not be overcome by the incrementation at branch 214.

The result of the foregoing steps is that if element 16 (FIG. 1) indicates imminent sparking the control signal (line 46 of FIG. 1) is decreased, otherwise it is increased. Thus the high voltage applied to precipitators 26 and 28 is at a relatively large value, just below the point at which sparking occurs. In this embodiment the control signal is varied by a fixed amount, although in other embodiments, the amount of change can be obtained according to a table, a formula or according to other measured parameters.

It will be observed from the foregoing, that microcomputer COM (FIG. 1) is able to respond quickly to the imminence of sparking and immediately attempt to reduce the conduction angle of controller 10 before sparking occurs. In this embodiment, controller 10 employs thyristors which cannot cease conducting until the end of a half cycle of power input 12. Accordingly, microcomputer COM need not respond before then. However, other embodiments may employ high speed switches or a saturable reactor, in which case its controller can be immediately disabled to avert sparking.

The foregoing described an operation in which sparking was prevented. In the event, however, that some massive disturbance produces a spark anyway, the following describes the system response thereto.

Figure 9:
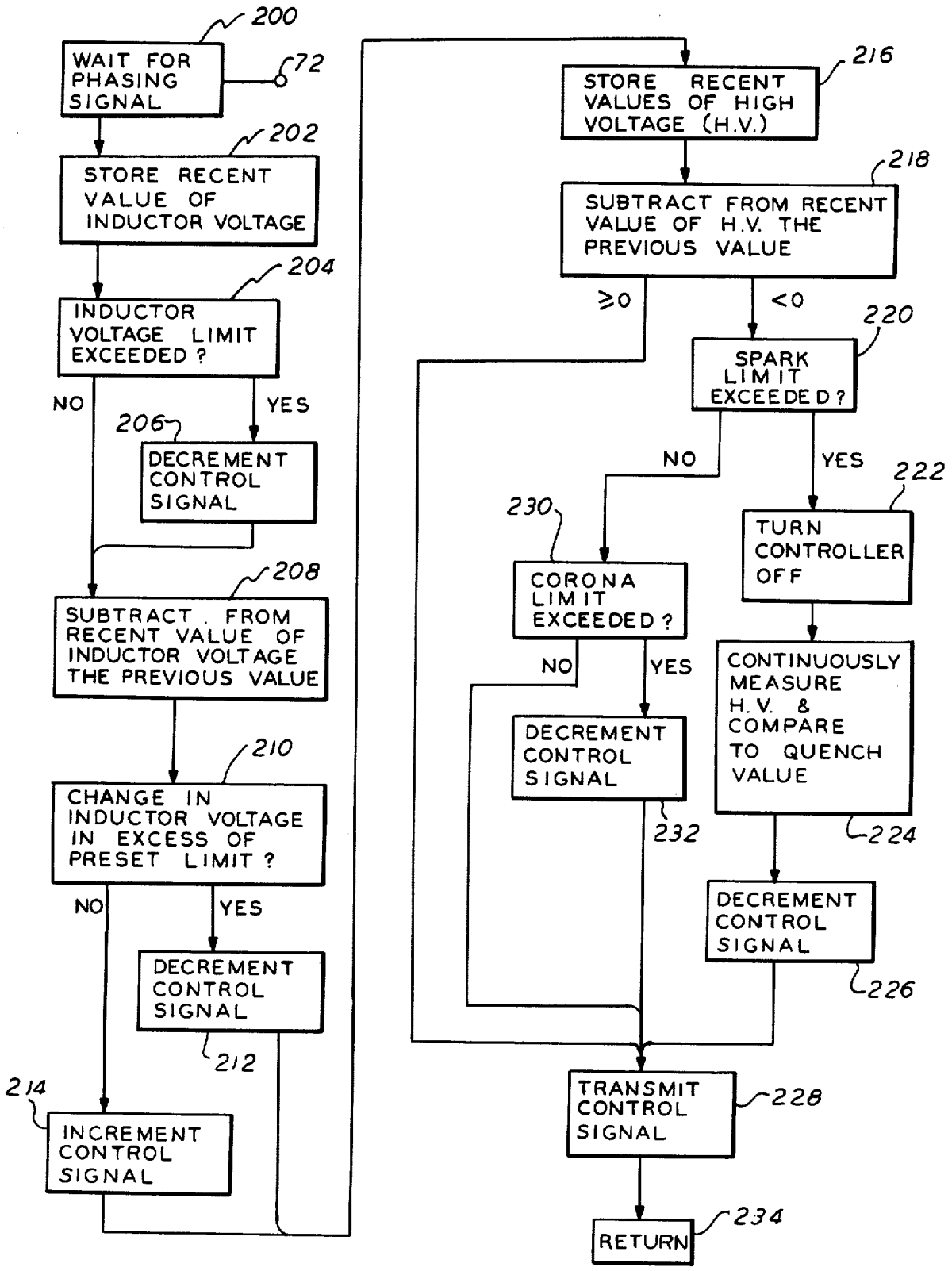
FIG. 9 is a flow diagram for the operations of FIGS. 1–7.

Assume that in the middle of a half cycle of power input 12 (FIG. 1) sparking commences in precipitator 26. As a result, the voltage on high tension electrode 22 abruptly falls. The relatively small voltage consequently produced at input IN6 is detected by microcomputer COM shortly thereafter. The latest value of IN6 is compared to the value occuring one-half cycle earlier, and if it exceeds a predetermined limit (for example, 25%) command means COM responds to this emergent condition by bringing the control signal on line 46 to a minimum value. This feature is also illustrated in the flow diagram of FIG. 9 which shows that immediately after the operation of previously described branch 212 or 214, the recent values of high voltage, obtained from inputs IN16 and IN6, are stored into memory. These recent values have subtracted from them the corresponding value of high voltage stored from the previous half cycle. If these differences are both greater than or equal to zero, no further adjustments to the control signal occur and the routine recycles as described hereinafter. If either of these differences are negative, indicating a fall in the high voltage, a comparison is made to a preset spark limit to determine if a spark has occurred. If the limit has been exceeded the following occurs as indicated by branches 220, 222, 224, and 226 of the flow diagram (FIG. 9).

The control signal is reset to zero in an attempt to disable controller 10 (FIG. 1). However, as previously mentioned, if the thyristors of controller 12 are already conducting they will continue to conduct at least until the end of the half cycle of power input 12. Since a spark appears to have commenced, microcomputer COM begins demanding data from input IN6 and IN7 at a relatively high rate. This elevated rate is important since controller 10 must remain off so long as sparking persists. Also, because the voltage needed to initiate a spark is substantially higher than the voltage needed to sustain it, the spark does not extinguish until the electrode voltage declines substantially. Therefore the voltages at inputs IN6 and IN7 are monitored on a "real time" basis until they recede below a quench value which insures spark extinction. (See oscillations and variations, FIG. 8C).

The time required to extinguish a spark can vary upon each occurrence thereof. While the voltage at electrodes 22 and 24 normally decline in the latter half of each half cycle of power input 12, this decline may be insufficient. Moreover, the capacitance of precipitators 26 and 28 may be sufficiently large to produce a very gradual decline in voltage. For these reasons microcomputer COM disables controller 10 for as long as the voltage on electrode 22 or 24 remain excessive. Once this voltage is no longer excessive the control signal is restored but at a value perhaps smaller (for example 0 to 4% reduction) than that existing in the half cycle in which sparking occurred. In this fashion the likelihood of repeated sparking is avoided.

Assuming the high voltages subside to below a quench value shortly after the commencement of a succeeding half cycle of power input 12, the operation associated with branch 228 (FIG. 9) occurs. This operation is the transmission of the restored control signal, followed by a return to the beginning of the sequence of operations, as indicated by branch 234. Having restored the control signal, one of the thyristors of controller 10 (FIG. 1) again conducts at a time (phase angle) determined by the control signal.

The foregoing sequence of operations just described in connection with FIG. 9 constitutes one microcomputer programming cycle. Accordingly, the microcomputer awaits the next occurrence of a phasing signal at the elapse of 75% of the current half cycle of power input 12, as indicated by branch 200.

The above sequence comprised a power cycle wherein sparking had occurred and wherein branch 222 (FIG. 9) was executed instead of branch 230. It will now be assumed that sparking did not occur and that instead a back-corona effect occurred throughout the last 25% of the relevant half cycle of power input 12. The back-corona effect is characterized by operation at a relatively high voltage in a region where a precipitator exhibits a negative impedance (negative slope on the voltage-current characteristic). Operation in such a region is inefficient and ought to be avoided.

Accordingly, after microcomputer COM (FIG. 1) determines that the decrement in the high voltage measurement of inputs IN6 and IN7 does not indicate sparking, the operation illustrated as branch 230 (FIG. 9) commences. This operation consists of determining whether this moderate decrease in high voltage exceeds a threshold (for example 5%) which would indicate a back-corona effect. If this corona limit is exceeded the control signal is decremented a predetermined amount (for example 1%) as indicated in branch 232. This decrement is greater than the increment which may be produced by the operation associated with branch 214. While the variation just described for the signal was a fixed decrement, in other embodiments a table, a formula or the value of the measured inputs IN1–IN5 may be employed to determine the variation of the control signal during the occurrence of a back-corona effect.

With the foregoing approach the voltages on electrodes 22 and 24 are periodically increased until the back-corona occurs. Upon occurrence of the back-corona, the conduction angle of controller 10 is decreased. In this manner, electrode voltage is kept around a peak which represents relatively high efficiency. It is apparent that if a back-corona did not occur and if the voltage to current characteristics of precipitators 26 and 28 were monotonic, then the precipitator voltage would increase until sparking was imminent.

Referring to FIG. 2 a schematic representation of a typical one of absoluting buffers ABS1, ABS2 or ABS3 of FIG. 1 is shown. A pair of operational amplifiers 48 and 50 are shown connected in parallel. Connected in parallel between the output and the inverting input of amplifier 48 are diode CR5 and the serial combination of resistor R20 and diode CR6. The cathode of diode CR5 and the anode of diode CR6 are connected to the output of amplifier 48, its non-inverting input being grounded. With resistor R22 connected between input P5 and the inverting input of amplifier 48, that amplifier provides at the output junction P6 of resistor R20 and diode CR6 a clipped output which is positive, unipolar and inverted.

Amplifier 50 applies to output P6 a clipped and non-inverted representation of the input on terminal P5. Connected in parallel between the inverting input and output of amplifier 50 is diode CR7 and the serial combination of diode CR8 and resistor R24. The cathode of diode CR7 and the anode of diode CR8 are connected to the output of amplifier 50, its non-inverting input being connected to terminal P5. The junction of resistor R24 and diode CR8 is connected to output terminal P6 which is shunted to ground by resistor R26.

The foregoing arrangement translates positive and negative inputs through unity amplifiers 50 and 48, respectively. Since only amplifier 48 provides inversion, the output on terminal P6 is the absolute value of the input signal of terminal P5. It is apparent that other arrangements such as a conventional full wave bridge can provide this function.

Referring to FIG. 3 a partial schematic representation of the controller 10 of FIG. 1 is shown. Thyristors Q1 and Q2 are connected in anti-parallel with their anodes and cathodes connected between primary power input P2 and output P4. Corresponding terminal designations appear in FIG. 1. Connected in parallel between the gate and cathode of thyristor Q1 are resistor R28 and secondary 52 of transformer T8. Connected in parallel between the gate and cathode of thyristor Q2 are resistor R30 and secondary 54 of transformer T9. Connected to control terminals P10 and P12 are one terminal from primaries 56 and 58, respectively, the other two primary terminals being connected together to a source of positive potential. Transformers T8 and T9 are phased so that momentary grounding of terminals P10 or P12 triggers thyristor Q1 or Q2, respectively, into conduction. Terminal P12 may be employed to initiate positive current flow (from terminal P2 to P4) while terminal P10 initiates negative current flow. Once triggered, thyristors Q1 and Q2 continue conducting until the anode to cathode voltage falls to substantially zero volts. Controllers according to FIG. 3 are commercially available and in practical embodiments they are more complicated than shown in this partial schematic.

Figure 4:
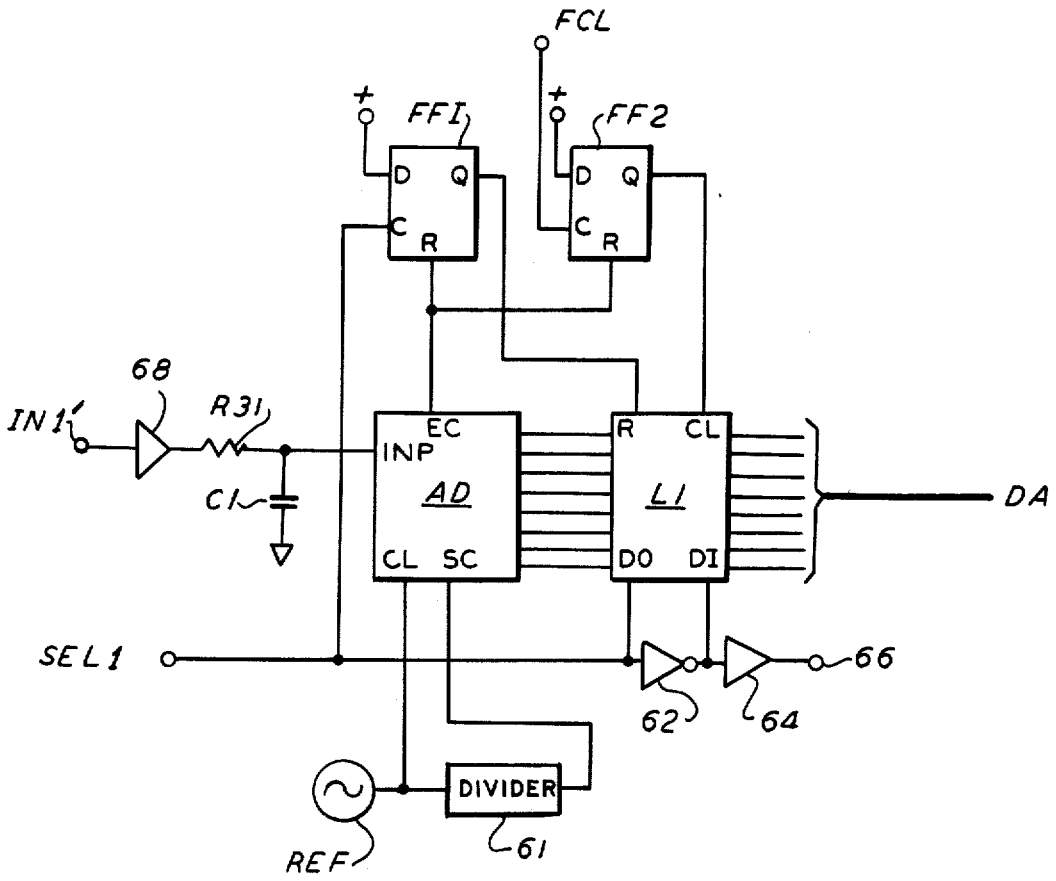
FIG. 4 is a block diagram of a triggered monitor means employed in the precipitator system of FIG. 1.

Referring to FIG. 4, a triggered monitor means is shown herein as analog to digital converter AD driving output latch L1, although other arrangements are possible. For example, if an analog rather than digital system is employed, the apparatus illustrated herein may be replaced by a well-known sample and hold circuit. Converter AD is a commercially available integrated circuit which converts an analog signal at input INP into parallel eight-bit data. These eight bits are transmitted to latch L1 by the eight lines illustrated. Operation of converter AD is initiated by applying a pulse to start input SC. The rate of conversion is regulated by an external timing source REF, operating at 1.0 mHz, which is connected to clock input CL of converter AD. The completion of conversion is signaled by a positive pulse being produced at terminal EC of converter AD. Start pulses are provided by divider 61 which has its input and output separately connected to terminals CL and SC, respectively, of converter AD. Thus connected, divider 61 can periodically initiate conversion at a repetition rate which is consistent with the speed of converter AD, for example, 18 kHz. Latch L1 is a pair of commercially available integrated circuits which store in eight internal flip-flops, data produced by converter AD. The data is stored in response to a rising clock pulse on input CL of latch L1, provided its input disable terminal DI is receiving a low (zero volts) signal. The data in latch L1 is connected to bus line DA, provided output disable terminal DO is low. A high signal (+5 volts) at reset input R of latch L1 forces all of its internal flip flops to a low state irrespective of its other inputs. The output EC of converter AD is shown connected to the reset inputs R of a pair of "D" type flip flops FF1 and FF2, their data inputs D being connected to a common high signal source. The outputs Q of flip flops FF1 and FF2 are separately connected to the reset input R and clock input CL, respectively, of latch L1. The clock inputs C of flip flops FF1 and FF2 are separately connected to terminals SEL1 and FCL, respectively. Terminal SEL1 is driven by microcomputer COM (FIG. 1) and is also connected to input DO of latch L1 and the input of inverter 62, whose output is connected to the input of buffer 64 and input DI of latch L1. The output of buffer 64, terminal 66, is commonly connected to the outputs of corresponding buffers in other converters. Similarly, the outputs of source REF, divider 61 and the clock signal of terminal FCL are commonly connected to corresponding inputs of other analog to digital converters. These other converters are employed to process the signals on inputs IN2–IN7. (FIG. 1). Terminal FCL receives a synchronizing signal which is employed by a microprocessor (shown hereinafter) in microcomputer COM (FIG. 1).

A trigger signal is supplied on terminal SEL1 from command means COM to cause latch L1 to couple its flip flops to bus lines DA. When such triggering is not occurring, the signal at terminal SEL1 is high and the apparatus of FIG. 4 converts the signal at input INP of converter AD as follows:

The production of a pulse from divider 61 initiates operation of converter AD which produces parallel eight-bit data representing the voltage at its input INP after approximately 42 microseconds. After such conversion a pulse is transmitted from output EC of converter AD to the reset inputs R of flip flops FF1 and FF2, causing their outputs Q to apply low signals to the inputs R and CL of latch L1. The next occurring synchronizing pulse at terminal FCL causes output Q of flip flop FF2 to rise and trigger clock input CL of latch L1. Since terminal SEL1 is high, causing an inverted low signal at input disable terminal DI, the flip flops of latch L1 receive and store the eight-bit data from converter AD. At this time the system is in a condition to accept another start pulse from divider 61 and repeat all of the foregoing operational sequences.

Assume now that a trigger signal is applied to terminal SEL1, causing a low signal at input C of flip flop FF1 and at input DO of latch L1 and an inverted high signal at input DI of latch L1. In response, latch L1 connects its internal flip flops to bus line DA so long as terminal SEL1 remains low. Thus this state causes data transmission on lines DA. It should be noted that since its input DI is high, latch L1 does not respond to its clock input CL. Thus there is no attempt to change data once transmission has commenced. Upon terminal SEL1 reverting to a high state, it triggers the clock input of flip flop FF1. In response, output Q of flip flop FF1 applies a high signal to reset input R of latch L1, driving its flip flops into a low state. As will become clear, this low state indicates that the time elapsed has been insufficient to allow converter AD to update the data in latch L1. When converter AD has completed another conversion cycle its output EC applies a pulse to reset the inputs R of flip flops FF1 and FF2. In response, these flip flops apply low signals to inputs R and CL of latch CL. In this condition, latch L1 is able to receive updated data from converter AD in response to the next synchronizing pulse on terminal FCL. This updating repeats in the manner previously described. so long as terminal SEL1 remains high.

The input applied to terminal INP of converter AD is derived from terminal IN1 which corresponds to the similarly identified input of FIG. 1. Input filter means is shown herein as a low pass filter comprising resistor R31 and capacitor C1, having their junction connected to input INP of converter AD. The other terminal of capacitor C1 is grounded and the other terminal of resistor R31 is connected to the output of buffer amplifier 68, whose output is connected to terminal IN1. Waveshapes representative of the signal at terminal IN1' are illustrated in timing diagram 8B of FIG. 8. The corresponding voltage fluctuations across high voltage transformer T1 (FIG. 1) and precipitator 26 (FIG. 1) are shown in timing diagrams 8A and 8C of FIG. 8, respectively. It may be observed from diagram 8B (FIG. 8) that input IN1' is in the form of a ramping signal having occasional high frequency bursts occurring during such ramping. These bursts correspond to the imminence or the occurrence of sparking.

The circuit between terminals IN1 and INP is an input filter means arranged to enhance system sensitivity to the imminence of sparking. While this circuit is preferably a low pass filter it may take several alternate forms. For example, it may comprise an integrator means or a bandpass filter or other processing circuitry. The specific circuitry employed will depend on the desired sensitivity and the expected waveshapes. The above-mentioned integrator means may employ a well-known integrator comprising an operational amplifier with negative capacitive feedback.

Figure 5:
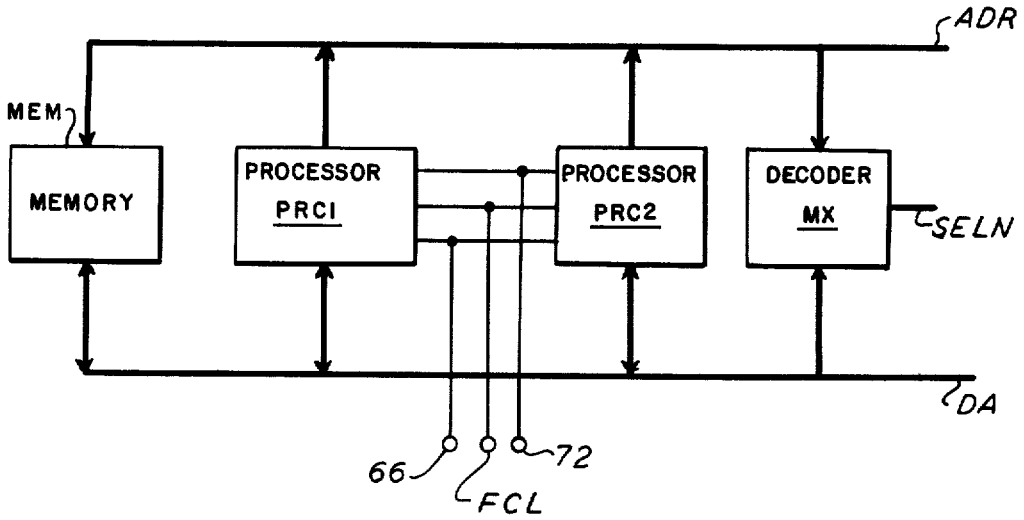
FIG. 5 is a block diagram of a microcomputer employed in the precipitator system of FIG. 1.

Referring to FIG. 5, microcomputer COM of FIG. 1 is shown in a more detailed block diagram form. While the microcomputer is shown herein as a pair of microprocessors PRC1 and PRC2, as previously mentioned, analog circuitry may be employed instead. Processors PRC1 and PRC2 are tied to common bus lines ADR and DA. Lines ADR are multi-bit lines onto which processors PRC1 and PRC2 transmit encoded address information. These addresses select a particular location in memory MEM, causing it to transmit stored information at that address over multi-bit data lines DA. Processors PRC1 and PRC2 and memory MEM are commercially available integrated circuits.

Connected to both processor PRC1 and PRC2 are terminals 66, 72 and FCL. Terminal FCL, previously described in connection with FIG. 4, provides a synchronizing clock signal from a source (not shown) which sequences the processors PRC1 and PRC2 through their various internal operations. Terminal 72 receives a sense signal upon expiration of 75% of a half-cycle of the power input 12 (FIG. 1). The circuitry for generating such a signal is described hereinafter. Terminal 66, previously described in connection with FIG. 4, provides an acknowledgment signal confirming that an analog to digital converter has been triggered by the processor PRC1 or PRC2.

A timing means is shown herein as decoder MX. Decoder MX triggers each individual analog to digital converter once for each half cycle of power input 12 (FIG. 1), under normal operating conditions. Decoder MX is responsive to address codes applied to it on address lines ADR. The signals on these lines represent different ones of the many analog to digital converters contained in subsystem 42 (FIG. 1). One such converter is converter AD of FIG. 4. Decoder MX has one trigger line for each of the analog to digital converters which it can trigger. Accordingly, lines SELN (FIG. 5) have at least seven lines to trigger the seven converters associated with the seven inputs IN1–IN7 (FIG. 1). One such trigger line is shown as terminal SEL1 in FIG. 4. Decoder MX also has a line for each of the input and output devices described subsequently.

The measured values received by the processors PRC1 and PRC2 are stored in a storage means shown herein as memory MEM which comprises eight ROM (read only memory) integrated circuits and twenty four RAM (random access memory) integrated circuits connected in the usual manner. Of course many alternate memory devices are currently available. These memory devices also store the computer program which resides primarily in the non-volatile ROM integrated circuits. The program is arranged to provide the functions previously described in connection with microprocessor COM (FIG. 1) and the diagram of FIG. 9. In general, the program will cause periodic triggering of the analog to digital converters of subsystem 42 (FIG. 1) to measure the status of the precipitators. As previously described, the magnitudes and changes of these parameters will be compared against certain standards stored in memory to determine if the controller 10 (FIG. 1) should be adjusted. In this manner, the program will set precipitator voltage at the highest level which does not cause unnecessary sparking or back-corona effects. The specific program instructions required to obtain the functions previously described in connection with FIG. 1 are apparent to persons skilled in this art. Moreover, such skilled artisans will be able to resequence the program instructions in various ways. For example, all measurements may be made in sequence prior to executing any logical programming instructions. Alternatively, measurements may be made immediately prior to their need in a specific calculation or logical decision. Moreover, the previously described response to imminent sparking or to back-corona effects may be contained in two separate programming subroutines which may be run in any order. In addition, during certain time intervals data may be taken so frequently and logical decision made so immediately that the program may be deemed running on what is referred to as a "real time" basis. Such a real time interval was previously described for an interval during which a spark occurred.

In view of the relative ease with which programming may be changed, it is anticipated that such changes may be incorporated from time to time by an operator. For example, an operator may change certain operating standards when the precipitator is expected to handle an unusually contaminated exhaust or where the ambient temperature or humidity may be unusual.

It is also appreciated that the block diagram of FIG. 5 is simplified but that the additional structural details are conventional and well-known to persons skilled in this art. Also, it is expected that processors PRC1 and PRC2 will have sufficient capacity to run accessories, e.g. rappers per U.S. Pat. No. 4,086,646.

Figure 6:
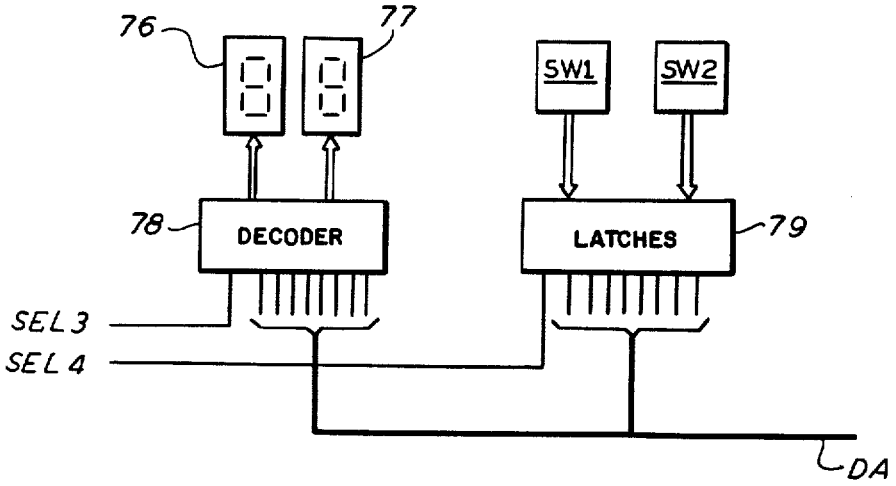
FIG. 6 is a block diagram of operator controls and displays associated with the precipitator system of FIG. 1.

Referring to FIG. 6, peripheral input and output devices cooperating with processors PRC1 and PRC2 (FIG. 5) are shown in an elementary block form. It is appreciated that most embodiments incorporating such peripherals will be more complex but that FIG. 6 serves to exemplify their operating principles.

A pair of seven segment displays 76 and 77 are driven by interface circuit 78. Circuit 78 includes latches which store the encoded information from data lines DA in response to a trigger input on line SEL3. After storage, decoder-drivers in circuit 78 drive numeric displays 76 and 77, thereby altering the operator to information developed by the processors PRCI and PRC2 (FIG. 5). Lines SEL3 and SEL4 are part of lines SELN (FIG. 5) and lines DA are the bus lines previously described.

Similarly, operator input can be dispatched by manual switches SW1 and SW2. These switches set latches in circuit 79 which can feed their data into lines DA in response to a trigger on line SEL4. Switches SW1 and SW2 may be part of a larger keyboard for dispatching alpha-numeric information along lines DA. The specific arrangement of integrated circuits within blocks 78 and 79 is so conventional that further elaboration is unnecessary to acquaint persons skilled in this art with the apparatus of FIG. 6.

Figure 7:
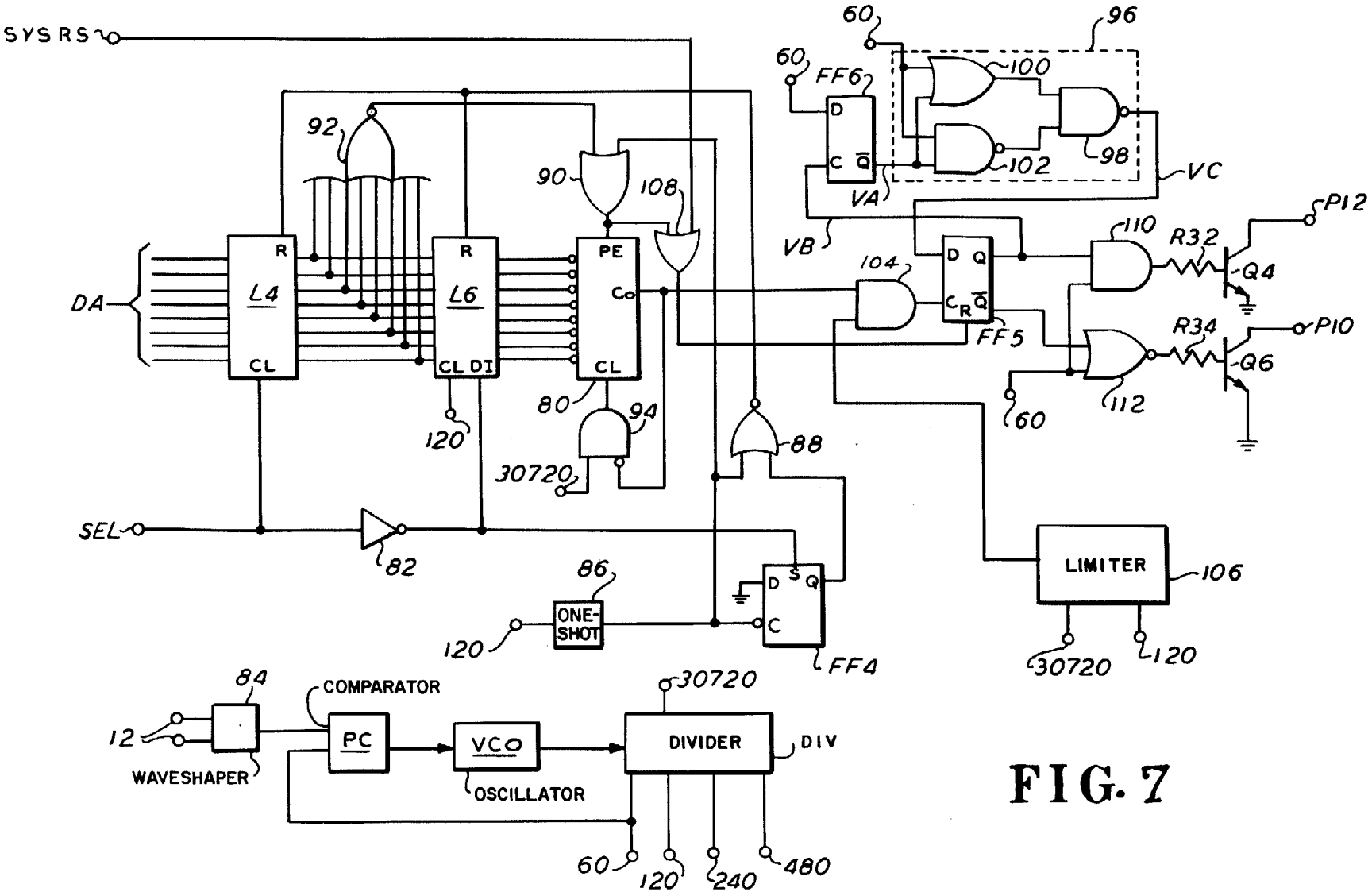
FIG. 7 is a block diagram showing the logic means and the interface between the voltage controller and command means employed in the precipitator system of FIG. 1.

Referring to FIG. 7, some of the details of circuitry contained in subsystem 44 (FIG. 1) are shown. It is to be understood that this drawing is a logic diagram and that the actual circuit may be contructed with additional gates or inverters. Previously mentioned data lines DA provide an eight-bit control signal which is connected to the data inputs of latch L4, whose data outputs are connected to the data inputs of latch L6. Latch L6 has its data outputs connected to the preset inputs of a counting means, shown herein as presetable down counter 80. Latches L4 and L6 are integrated circuits each having eight internal flip flops. Data is stored therein upon application of a high signal to their respective clock inputs CL. Clock inputs CL of latches L4 and L6 are connected to terminals SEL and 120, respectively. Input disable terminal DI of latch L6 is driven by inverter 82, whose input is connected to terminal SEL. Application of a high signal on terminal DI of latch L6 effectively replaces its data inputs with all low signals. Terminal SEL is connected to one of lines SELN (FIG. 5). Terminal SEL is driven negative when a new control signal is being provided.

Terminal 120 is energized by a local phase locked loop comprising waveshaper 84, phase comparator PC, voltage controlled oscillator VCO and divider DIV. Waveshaper 84 comprises an isolated comparator which produces a square wave at the same frequency as the power line input 12 (shown herein and FIG. 1). Voltage controlled oscillator VCO, producing nominal 122.88 kHz signal, drives divider DIV which produces five outputs whose frequencies are related to the frequency of oscillator VCO by the divisor $2^n$. In particular, for the nominal input of 122.88 kHz, outputs of 30720, 480, 240, 120 and 60 Hz are provided on terminals 3072, 480, 240, 120 and 60, respectively. The nominal 60 Hz signal at terminal 60 is compared in phase by comparator PC to the power-synchronous output from waveshaper 84. Comparator PC produces a voltage at the control input of oscillator VCO in such a way as to lock its phase onto that of the power line input 12, in a well-understood manner. The components of the foregoing phase-locked loop are fabricated from integrated circuits which are produced commercially for such a purpose.

A combinational logic means is provided herein by the arrangement of NOR gate 92. NOR gate 92, having its eight inputs connected to the data lines between latches L4 and L6, produces a high output when these data lines are all low.

The signal on terminal 120 is coupled to the trigger input of monostable multivibrator 86 which produces a pulse having a duration of approximately 65 microseconds. The output of one-shot 86 is coupled to inverse clock input C of "D" type flip flop FF4 whose D, S and Q terminals are connected to ground, the output of inverter 82 and an input of NOR gate 88, respectively. The other input of NOR gate 88 is connected to the output of one-shot 86 and one input of OR gate 90. OR gate 90 has its other input connected to the output of NOR gate 92. The output of NOR gate 88 is connected to reset inputs R of latches L4 and L6. The output of OR gate 90 drives preset enable input PE of down counter 80, whose clock input CL is driven by AND gate 94. Previously described terminal 30720 is connected to a non-inverting input of AND gate 94, its inverting input being connected to carry output CO of counter 80. Carry output CO drives an initiate means shown herein as a flip flop FF5. Coupled thereto is a disable means 96. Disable means 96 is shown as a phase means comprising first gate 100 and second gate 102 driving combining means 98. While gates 98, 100 and 102 are specifically shown as NAND gate 98 whose inputs are separately driven by OR gate 100 and NAND gate 102, other arrangements of combinational or sequential logic are possible using positive or negative logic. The output of NAND gate 98 is coupled to input D of flip flop FF5. A polarity means is shown herein as a pilot means comprising flip flop FF6.

Gates 100 and 102 each have one input connected to terminal 60, the other two inputs being connected to output $\overline{Q}$ (line VA) of "D" type flip flop FF6. An examination of circuit 96 will reveal that it produces a high signal on line VC when the signal at terminal 60 is in phase with output $\overline{Q}$ of flip flop FF6 (in phase meaning both are high or both are low).

Flip flop FF6 has its inputs D and C separately connected to terminal 60 and output Q of flip flop FF5, respectively. The input C of flip flop FF5 is driven by AND gate 104, whose inputs are separately connected to output CO of counter 80 and the output of limit device 106. Device 106 is driven by the signals on terminals 120 and 30720 to provide a positive-going pulse whose duty cycle is manually adjustable. The trailing edge of this pulse is synchronized by terminal 120. The structure of device 106 is similar to that associated with counter 80. Reset input R of flip flop FF5 is connected to the output of OR gate 108 whose inputs are separately connected to terminal SYSRS and the output of OR gate 90. Terminal SYSRS may have a manual override signal connected to it. As will become clear, production of a high signal on terminal SYSRS prevents operation of controller 10 (FIG. 1).

Resistor R32 is connected between the base of NPN transistor Q4 and the output of AND gate 110. Resistor R34 is connected between the base of transistor Q6 and the output of NOR gate 112. Outputs Q and $\overline{Q}$ of flip flop FF5 are separately connected to one input of gates 110 and 112, respectively. The other two inputs of these gates are connected to terminal 60. Terminals P10 and P12 (herein and FIG. 3) are separately connected to the collectors of transistors Q6 and Q4, respectively, their emitters being grounded. The output Q of flip flop FF5 is identified as line VB.

Figure 8:
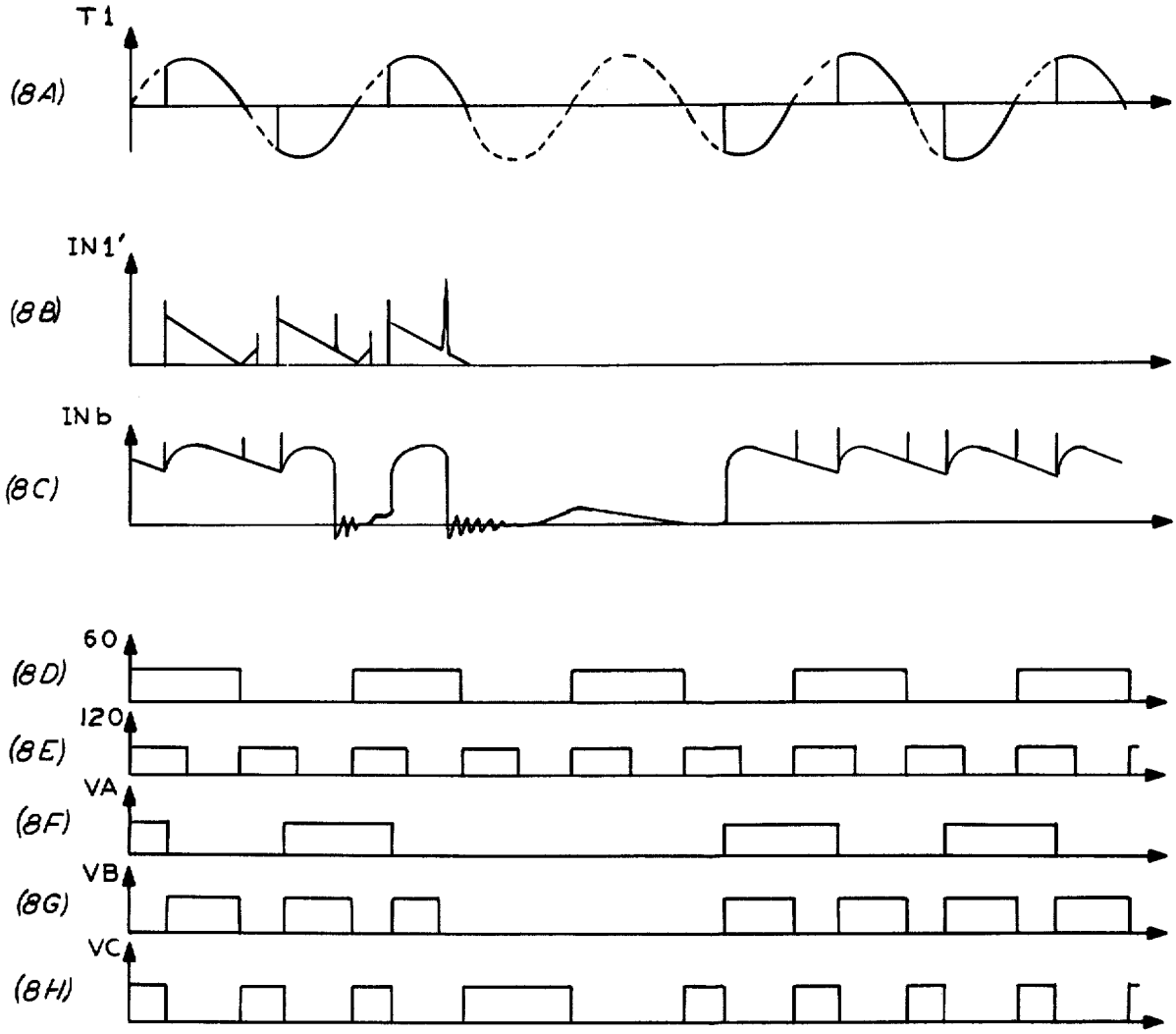
FIG. 8 is timing diagram for signals occurring in FIGS. 1–7.

To facilitate an understanding of the apparatus of FIG. 7 its operation will be described first under normal conditions and then under conditions where sparking occurs. As an aid, timing diagrams 8D–8H of FIG. 8 show the timing between the signals on lines 60, 120, VA, VB and VC, respectively.

Transmission of a control signal is indicated by a negative-going pulse on terminal SEL (FIG. 7). It is assumed such transmission occurs shortly before the end of a half cycle of power input 12, in anticipation of the control desired for a succeeding half cycle. This negative-going trigger pulse on terminal SEL is inverted by inverter 82 which drives set input S of flip flop FF4, whose output Q becomes high as a result. This high output is coupled to NOR gate 88, ensuring that this gate applies a low signal to the reset lines R of latches L4 and L6. The trailing edge of the negative-going pulse on terminal SEL triggers clock input CL of latch L4 causing it to store the data on lines DA.

Terminal 120, being phase locked to power line 12, produces a negative-going transition at the end of the present half cycle of power input 12. Accordingly, terminal 120 drives clock input CL of latch L6 and causes it to replicate the data from latch L4 at the end of this and each succeeding half cycle of power input 12. The signal of terminal 120 also drives one-shot 86 which applies through OR gate 90 a positive pulse to preset enable input PE of down counter 80. This presets the counter 80. The preset inputs of counter 80 are illustrated as inverting or complimenting inputs. Accordingly, the binary compliment, or 255 minus the numeric output of latch L6, is employed to preset counter 80. Provided the binary number supplied from latch L6 was not zero, the carry output CO of counter 80 becomes low, allowing AND gate 94 to transmit the 30.72 kHz signal on terminal 30720 to clock input CL of counter 80. Once the outputs of one-shot 86 and OR gate 90 return to zero, AND gate 94 causes counter 80 to count backwards from the preset, complimented input, at a rate of 30.72 kHz. For example, if latch L6 transmits a count of 100, counter 80 is preset to 155 and counts down to zero in about five milliseconds. As will become clear the count provided by latch L6 is proportional to the angle of conduction of controller 10 (FIGS. 1 and 2). Upon reaching a zero count, counter 80 produces a high signal from carry output CO which when applied to AND gate 94, prevents further clocking of counter 80.

Reviewing the foregoing, output CO of counter 80 produced a low signal which commenced in response to the triggering of terminal 120. This transfer to a low state will be periodic and will occur once every half cycle of power input 12. The duration of the low signal of output CO is proportional to the binary compliment of the data provided by latch L6. Since output CO is cyclic, it may also be viewed as a positive-going pulse whose duration is proportional to the uncomplimented data provided by latch L6.

Since normal conditions are being considered, it will be assumed for now that the signals from terminal SYSRS, and the output of device 106 are high and that the output of NOR gate 92 is low, for all relevant time intervals. It will also be assumed that flip flop FF6 is in its reset state.

This being the case, the next positive transition of the signal of terminal 60 corresponds to the commencement of a positive half cycle for power input 12. Simultaneously therewith, the signal on terminal 120 undergoes a positive transition while output CO of counter 80 undergoes a negative transition in response thereto. Since terminal 60 and output $\overline{Q}$ of flip flop FF6 are now in phase, a positive signal is applied by circuit 96 to the D input of flip flop FF5. The positive transition of terminal 120 transmits a short pulse through devices 86, 90 and 108 to reset input R of flip flop FF5, producing on its Q and $\overline{Q}$ outputs a low and high signal, respectively. In response, gates 110 and 112 apply low signals to the bases of transistors Q1 and Q2, turning them off without further effect.

After a time determined by counter 80, its carry output undergoes a positive transition, in the manner previously described. This rising signal is transmitted through AND gate 104 to clock input C of flip flop FF5. Since, as previously mentioned, input D of flip flop FF5 is high, the transition at its input C causes it to change state. Since this change applies a high signal to one input of AND gate 110 and since the other input of AND gate 110 is connected to the high signal at terminal 60, AND gate 110 turns transistor Q4 on. By turning on, transistor Q4 triggers thyristor Q2 (FIG. 3 through pulse transformer T9. In this manner controller 10 (FIG. 1) provides a positive current for the balance of the half cycle presently being considered.

The foregoing change in state experienced by flip flop FF5 produces a positive transition at clock input C of flip flop FF6. Since its input D is still high, flip flop FF6 also changes state, producing a low signal from its output $\overline{Q}$. Since this output is now out of phase with terminal 60, circuit 96 applies a low signal to input D of flip flop FF5, without further effect.

At the commencement of the succeeding half cycle of power input 12, the signals of terminals 60 and 120 undergo a negative and positive transition, respectively. Similar to the preceding half cycle, flip flop FF5 is again reset. Having changed, terminal 60 is again in phase with output $\overline{Q}$ of flip flop FF6, causing circuit 96 to apply a high signal to input D of flip flop FF5. In the same manner as before, counter 80 produces a low signal at its output CO for an interval determined by the count preset by latch L6. When this output CO eventually undergoes a positive transition, it is transmitted through AND gate 104 to clock input C of flip flop FF5. Since its D input is now high, flip flop FF5 changes state and applies a low signal to one input of NOR gate 112, whose other input also receives a low signal from terminal 60. In response, gate 112 drives transistor Q6 into conduction, thereby triggering thyristor Q1 (FIG. 3). Once triggered thyristor Q1 supplies negative current for the balance of the half cycle presently being considered. The foregoing change in state of flip flop FF5 also causes its output Q to trigger input C of flip flop FF6, causing flip flop FF6 to change state. Since output $\overline{Q}$ of flip flop FF6 then becomes out of phase with the signal of terminal 60, circuit 96 applies a low signal to input D of flip flop FF5 without further effect. In this condition the apparatus is prepared to repeat another cycle in the manner just described. Thus, when the succeeding half cycle commences the signal at terminal 60 again becomes in phase with output $\overline{Q}$ of flip flop FF6.

Assume now that instead of continued normal operation, sparking occurs prior to and throughout this succeeding half cycle. As a result transformer T1 (FIG. 1) is overloaded and driven toward saturation. In response, source 22 (FIG. 1) applies to lines DA (FIG. 3) a zero binary signal. This zero signal is fed into latches L4 and L6 shortly before the commencement of this succeeding half cycle. As a result, all of the inputs to NOR gate 92 are low, producing therefrom a high signal. Notwithstanding that counter 80 may be counting, the high output of gate 92 is transmitted through gate 90 to preset counter 80 to its maximum count prior to this succeeding half cycle. Moreover, since it is assumed sparking persists prior to and throughout this succeeding half cycle, the high output of NOR gate 92 likewise persists. As a consequence, output CO of counter 80 remains low for this entire half cycle.

Since flip flop FF5 is not triggered for this succeeding half cycle neither it nor flip flop FF6 change state. Accordingly, after the expiration of this succeeding half cycle, the signal at terminal 60 becomes out of phase with output $\overline{Q}$ of flip flop FF6. In response circuit 96 applies a low signal to input D of flip flop FF5. So long as this signal at this input D persists, flip flop FF5 cannot change state and transistors Q4 and Q6 remain off, disabling the controller 10 (FIGS. 1 and 3). Therefore, if gate 92 (FIG. 7) disables controller 10 (FIG. 1) for one half cycle, power will not be restored in the next half cycle. Accordingly, until phase coherence between terminal 60 and output $\overline{Q}$ of flip flop FF6 is restored, normal operation is prevented. In fact, the phasing just described will ensure that when power is restored it will be timed to apply current in a direction opposite to that occurring prior to power interruption.

This feature ensures that the magnetizing force in transformer T1 (FIG. 1) when restored will be in a direction opposite to that which occurred during sparking. Thus the transformer will be driven out of saturation, not into saturation.

In an analogous fashion, an operator may transmit a high signal on terminal SYSRS through gate 108 to reset input R of flip flop FF5. Since flip flop FF5 is forced into a reset state, transistors Q4 and Q6 cannot conduct. Therefore controller 10 (FIG. 1) is again disabled.

It is also to be observed that for a manually adjustable interval starting at the commencement of each half cycle of power input 12, device 106 applies a low signal to one input of AND gate 104. It is apparent that device 106 establishes the earliest time at which flip flop FF5 can be triggered. Therefore device 106 sets the maximum conduction angle for controller 10 (FIG. 1).

As previously mentioned, the apparatus described in connection with the nine foregoing figures, may be constructed in alternate fashions using a different balance of digital and analog circuitry. Moreover, it is apparent that various alternate microprocessor programs may be employed in accordance with the above teachings. Also the sensitivity of the system to measured parameters may be adjusted to suit the specific precipitator that is being controlled. Furthermore, it is anticipated that other embodiments will employ circuit components having different tolerances and ratings to provide the desired accuracy, power, speed etc. Thus a latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

* * * * *